US007000442B2

(12) United States Patent
Mizukawa

(10) Patent No.: US 7,000,442 B2
(45) Date of Patent: Feb. 21, 2006

(54) ROTARY DIE BLADE MEMBER BENDING METHOD, AND ROTARY DIE BLADE MEMBER BINDING DEVICE

(76) Inventor: Suehiro Mizukawa, 4-25, Torikainishi 5-chome, Setto-shi, Osaka 566-0072 (JP)

( * ) Notice: Subject to any disclaimer, the term of this patent is extended or adjusted under 35 U.S.C. 154(b) by 121 days.

(21) Appl. No.: 10/475,156

(22) PCT Filed: Jun. 4, 2002

(86) PCT No.: PCT/JP02/05493

§ 371 (c)(1),
(2), (4) Date: Oct. 15, 2003

(87) PCT Pub. No.: WO02/102529

PCT Pub. Date: Dec. 27, 2002

(65) Prior Publication Data

US 2004/0112108 A1 Jun. 17, 2004

(30) Foreign Application Priority Data

Jun. 15, 2001 (JP) ..... 2001-181378

(51) Int. Cl.
*B21D 5/01* (2006.01)

(52) U.S. Cl. ..... 72/307; 72/377; 72/379.2; 76/107.8

(58) Field of Classification Search ..... 72/307, 72/167, 377, 379.2, 416, 407, 76; 76/107.8, 76/104.1

See application file for complete search history.

(56) References Cited

U.S. PATENT DOCUMENTS

| | | | | | |
|---|---|---|---|---|---|
| 151,544 | A | * | 6/1874 | Moore | 72/416 |
| 174,388 | A | * | 3/1876 | Taplin | 72/199 |
| 319,442 | A | * | 6/1885 | Bellamy | 72/129 |
| 877,315 | A | * | 1/1908 | Fehr | 72/416 |
| 1,452,499 | A | * | 4/1923 | Flinn | 72/378 |
| 2,414,178 | A | * | 1/1947 | Sprinkle | 72/412 |
| 2,968,974 | A | * | 1/1961 | Everett | 72/339 |
| 3,926,031 | A | * | 12/1975 | Neilsen | 72/407 |
| 5,251,514 | A | * | 10/1993 | Rhodarmer et al. | 76/104.1 |

* cited by examiner

*Primary Examiner*—Daniel C. Crane
(74) *Attorney, Agent, or Firm*—Lucas & Mercanti, LLP

(57) ABSTRACT

Method and apparatus for making a rotary die blade from a straight blade blank to be conformable to the contour of the rotary die block include inserting a blade blank between a first press face of a first presser and a second press face of a second presser; and compressing the blade blank by urging either of the first press face or the second press face to the other, thereby elongating the blade blank along its length; wherein the compressive force is differentiated such that a stronger compressive force is applied to the peripheral portion of the blade blank than the inner portion thereof.

13 Claims, 17 Drawing Sheets

ROTARY DIE BLADE MEMBER BENDING METHOD, AND ROTARY DIE BLADE MEMBER BINDING DEVICE

TECHNICAL FIELD

The present invention relates to method and apparatus for making a rotary die blade from a straight blade blank, and more particularly, method and apparatus for making a rotary die blade from a straight blade blank conformable to the contour of the die block.

BACKGROUND ART

A rotary die equipped with a blade is used for perforating a work, such as paper, to facilitate separation, or for punching or stamping. FIGS. 14 and 15 show a rotary die block 100 and a rotary anvil 200 used in association with the rotary die block 100. The die blade 1 has a cutting edge 12 which is curved along the contour of the die block, and projected beyond its periphery so as to penetrate a work (W) such as paper or metal sheet.

By referring to FIGS. 14 and 15, the conventional rotary die unit will be described:

A work (W) such as paper or metal sheet is passed between the rotary die 100 equipped with a die blade 1 and the rotary anvil 200 in the direction (F) indicated by the arrow. While passing therebetween, the work (W) is subjected to perforating or slitting or stamping operations as desired by the blade 1. The rotary anvil 200 has two kinds; one having a hard surface as of iron, and the other having a soft surface made as of rubber, depending upon the nature of the work (W).

The blade 1 fixed to the rotary die block 100 has two kinds; one is obtained by curving a straight strip shown in FIG. 16, and shaping it on the user's side as shown in FIG. 17, and the other is obtained by procuring a previously curved blade commercially available. In the latter case, it will be very handy if the obtained blade has a curvature as desired, and in the former case, the blade can be curved on the user's side to a desired curvature, where, as shown in FIG. 17, three rollers 301, 302 and 303 are employed with one being inside and the other two outside. Each of the rollers 302 and 303 is provided with a groove on its rim so as to support the edge 12 in a non-contact manner. This method is disclosed in Japanese Patent Publication No. 46 (1971)-18352.

The problem arises from the latter case shown in FIG. 19, in the form of the betrayal of the expectations of handiness and readiness because of the difficulty in selecting a curvature agreeable to the desired value. The problem of the former case shown in FIG. 17 is that parts (A) are likely to remain unprocessed because of the structural limitation inherent in the illustrated type of machine. These unprocessed parts (A) must be removed by an extra process, thereby increasing the production cost.

Therefore, an object of the present invention is to provide a method and apparatus for obtaining rotary die blades conformable to the contour of the die block throughou its full length.

Another object of the present invention is to provide a method and apparatus for variously shaping the edge of the die blade as the user desires.

A further object of the present invention is to provide a method and apparatus for ensuring the conformity of the die blade to the contour of the rotary die block without requiring a special skill.

A still further object of the present invention is to provide a method and apparatus for ensuring the conformity of the die blade to the contour of the rotary die block under a computer control.

SUMMARY OF THE INVENTION

According to one aspect of the present invention, there is provided a method for making a rotary die blade from a straight blade blank, includes inserting a blade blank between two pressers, that is, a first presser having a first press face, and a second presser having a second press face, respectively; and compressing the blade blank by urging either of the first press face or the second press face to the other, thereby elongating the blade blank along its length under compression, wherein a stronger compressive force is applied to the peripheral portion of the blade blank than to the inner portion thereof.

In an alternative embodiment the blade blank is provided with a plurality of slits produced at intervals, wherein the distance between the bottom of each slit and the outside rim of the blade blank is not larger than one half of the full width of the blade blank.

According to another aspect of the present invention, there is provided an apparatus for making a rotary die blade from a straight blade blank, includes a first presser having a first press face and a second presser having a second press face; a first carrier carrying the first presser; a second carrier carrying the second presser; and a housing for accommodating the pressers and the carriers of the pressers; wherein either of the first carrier or the second is movable to and from the other carrier, thereby bringing the press faces into contact with each other so as to compress the blade blank.

In an alternative embodiment, each of the first and second press faces is inclined so as to form an upwardly diverged space between the two press faces, thereby differentiating the compressive force between a lower section and an upper section of the diverged space when the two press faces are brought into contact with each other.

DETAILED DESCRIPTION OF THE PREFERRED EMBODIMENTS

Figure 1:
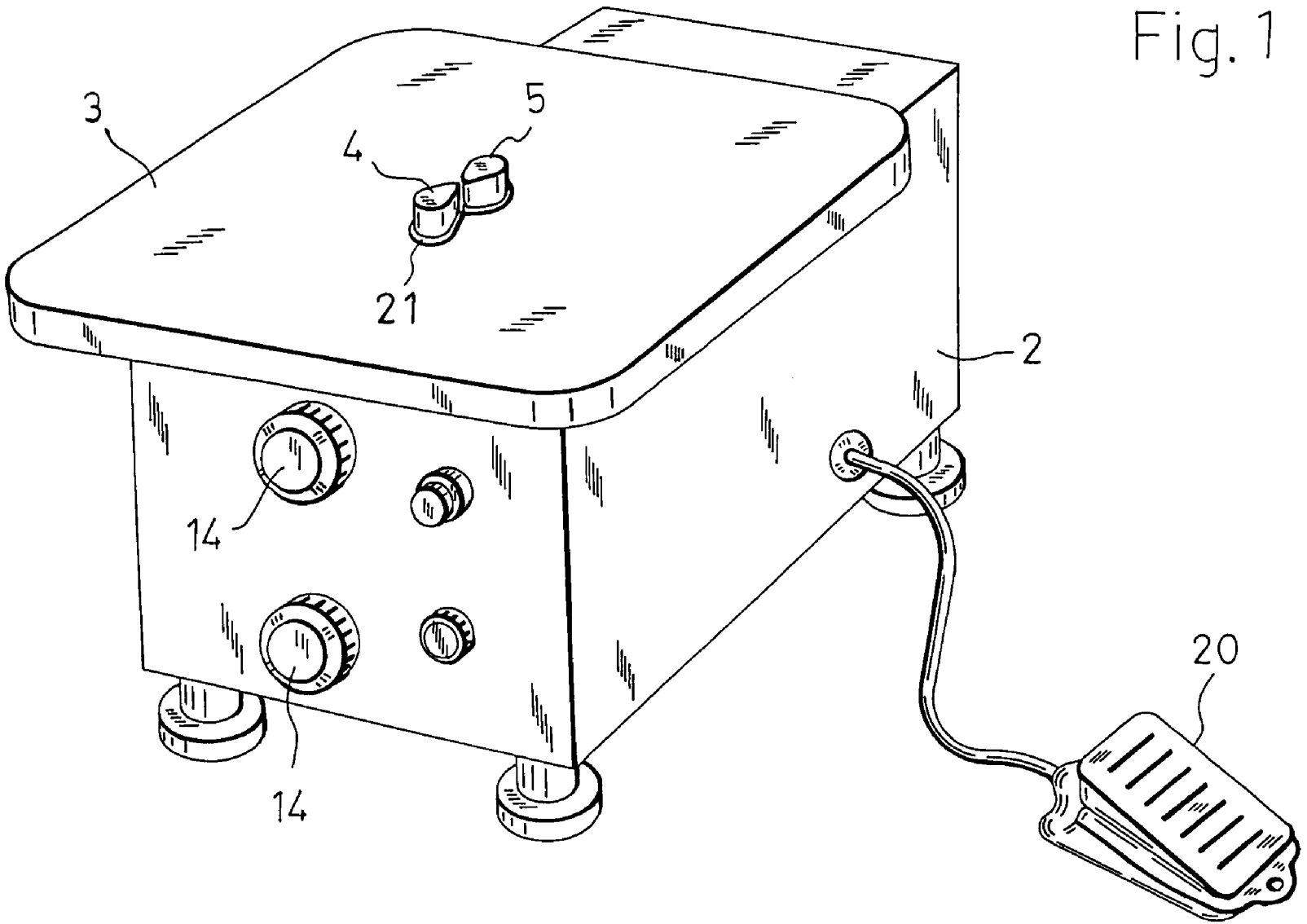
FIG. 1 is a diagrammatic perspective view showing an apparatus embodying the present invention.
Figure 2:
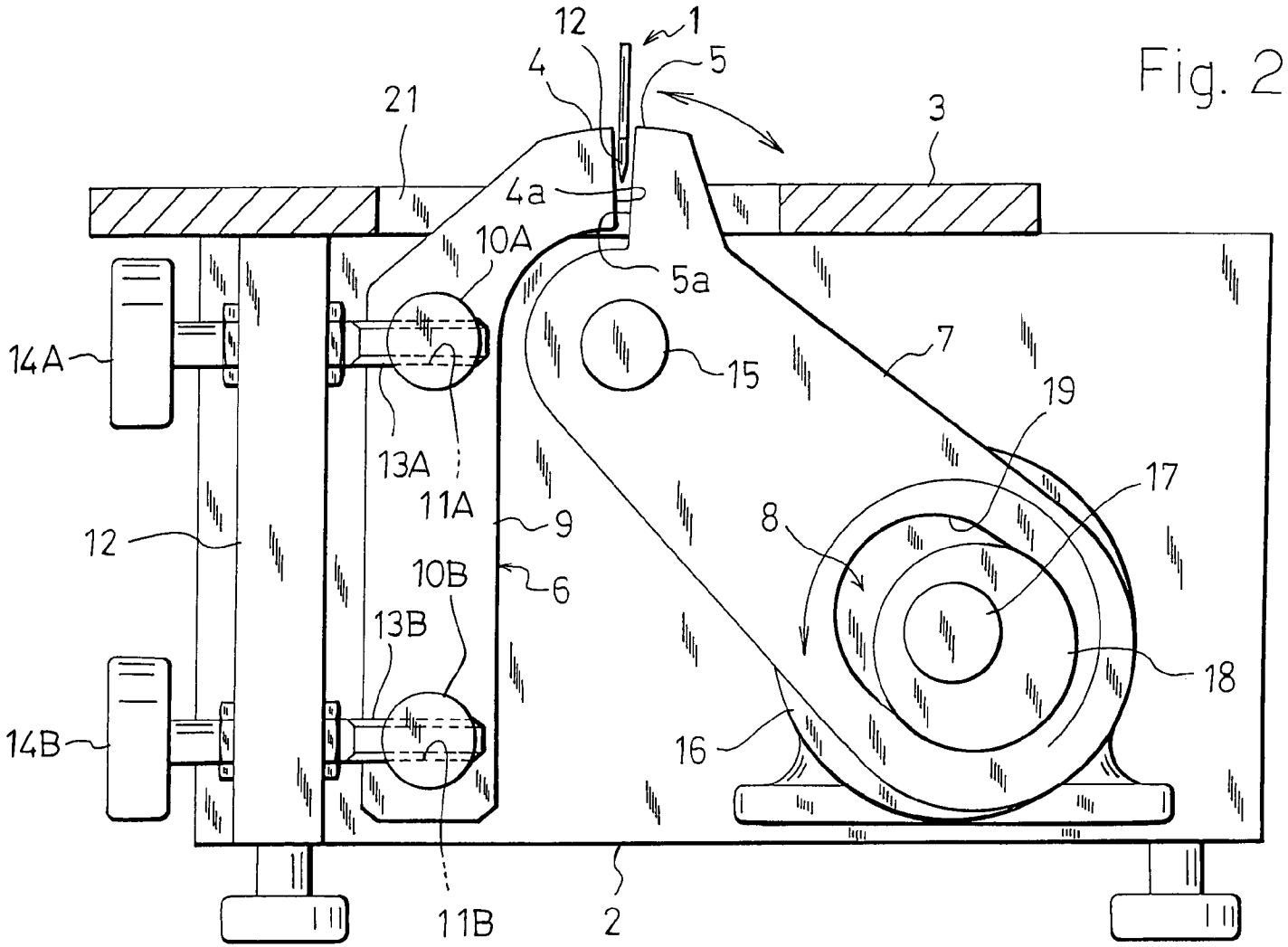
FIG. 2 is a diagrammatic side view to show the internal structure of the apparatus shown in FIG. 1.

Referring to FIGS. 1 and 2, an apparatus embodying the present invention will be more particularly described by way of example:

The apparatus includes a box 2, a working table 3 thereon, and a pair of pressers 4, 5 whose heads project through a slit 21 produced in the top surface of the working table 3. The pressers 4 and 5 include a body 6 and an arm portion 7, respectively, each accommodated in the box 2 as shown in FIG. 2. The presser 4 has a press face 4*a*, and the presser 5 has a press face 5*a* mating with the press face 4*a* when a blade blank is inserted therebetween.

The body 6 includes a column portion 9, and is moved to the left and right in FIG. 2 by means of handles 14A and 14B, thereby adjusting an angle at which the press face 4*a* is faced to the press face 5*a* of the presser 5. The column portion 9 is provided with known connectors 10 (their details are omitted for simplicity) each having a threaded bore 11, the connectors 10 being rotative around their axis.

Each of the handles 14A and 14B has a threaded bar 13A and 13B, respectively, engageable with the threads of the bore 11A and 11B, the threaded bar 13A being passed through a side wall 12A of the box 2. Likely, the threaded bar 13B is passed through a side wall 12B. The threaded bars 13A and 13B advance and retreat in accordance with a clockwise or counter-clockwise rotation of the handles 14A and 14B, thereby adjusting an angle of decline of the press face 4*a* of the presser 4 against the press face 5*a* of the presser 5.

The arm portion 7 of the presser 5 is rotatively supported by a shaft 15, and includes an eccentric cam unit 8 that consists of a rotary cam 18 fixed to a rotary shaft 17 of an electric motor 16. The rotary cam 18 is housed in a hole 19 with a free space. When the rotary cam 18 is driven by the motor 16, the cam 18 is caused to slide in the arrow direction on and along the periphery of the hole 19, so that the arm portion 7 is caused to rotate around the shaft 15. As a result of the rotary movement of the arm portion 7, the presser 5 is caused to approach and separate from the presser 4. The motor 16 is operated by a switch 16 (FIG. 2).

Figure 3:
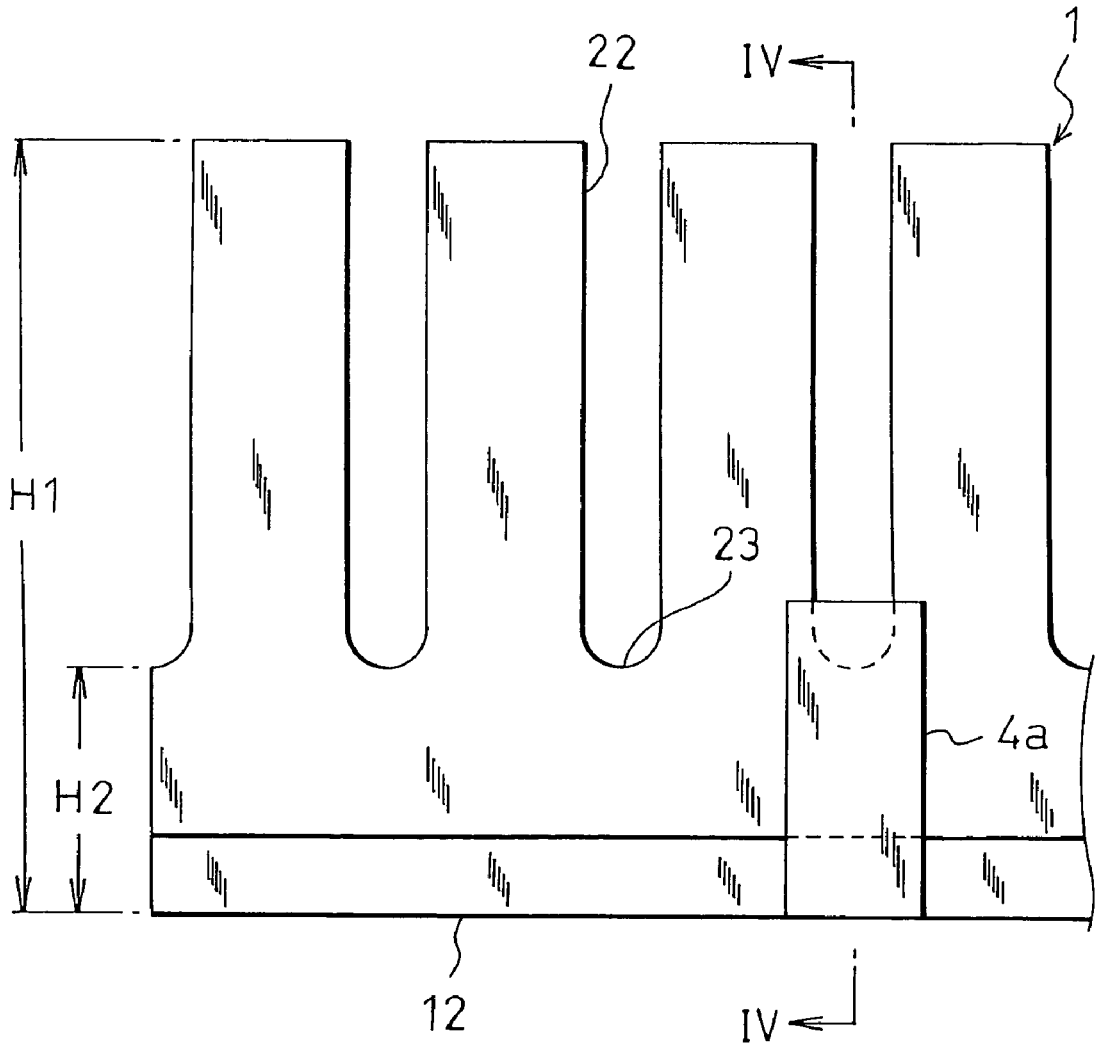
FIG. 3 is an explanatory view showing the positional relationship between a blade blank and the presser.

As shown in FIG. 3, a blade blank (pre-processed at this stage) 1 has a rim having an edge 12, and a flat side having slits 22 at intervals along the rim. Each slit 22 has a bottom 23, spaced from the edge 12 by H2, in contrast to the full width H1. The width H2 is not larger than one half of the width H1.

Figure 4A:
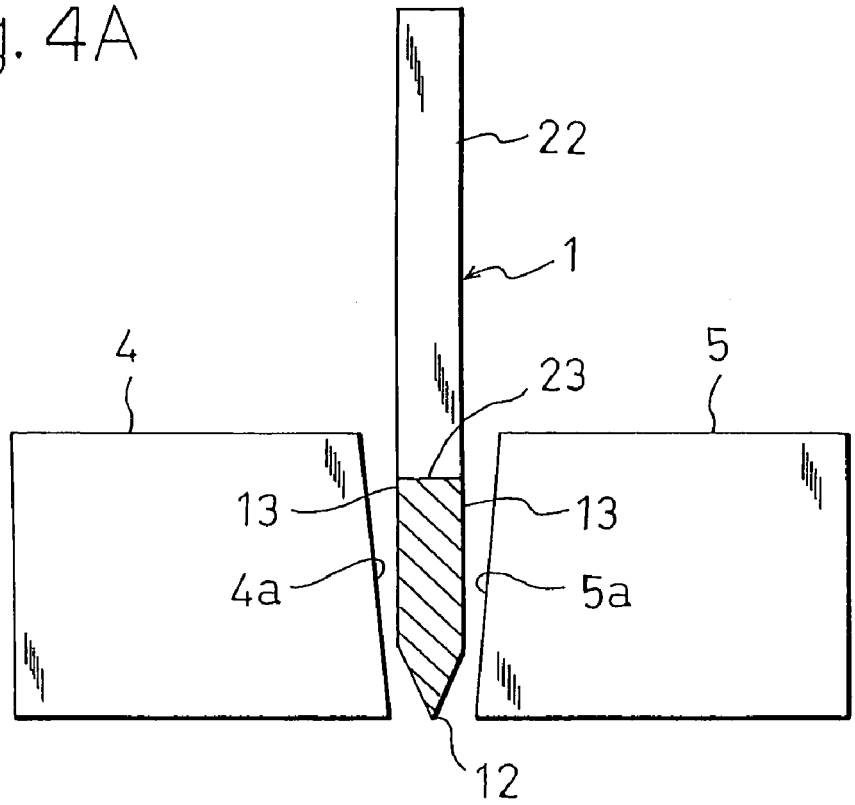
FIG. 4A is a diagrammatic sectional view taken along IV—IV line in FIG. 3 where a blade blank is inserted between the two pressers.
Figure 4B:
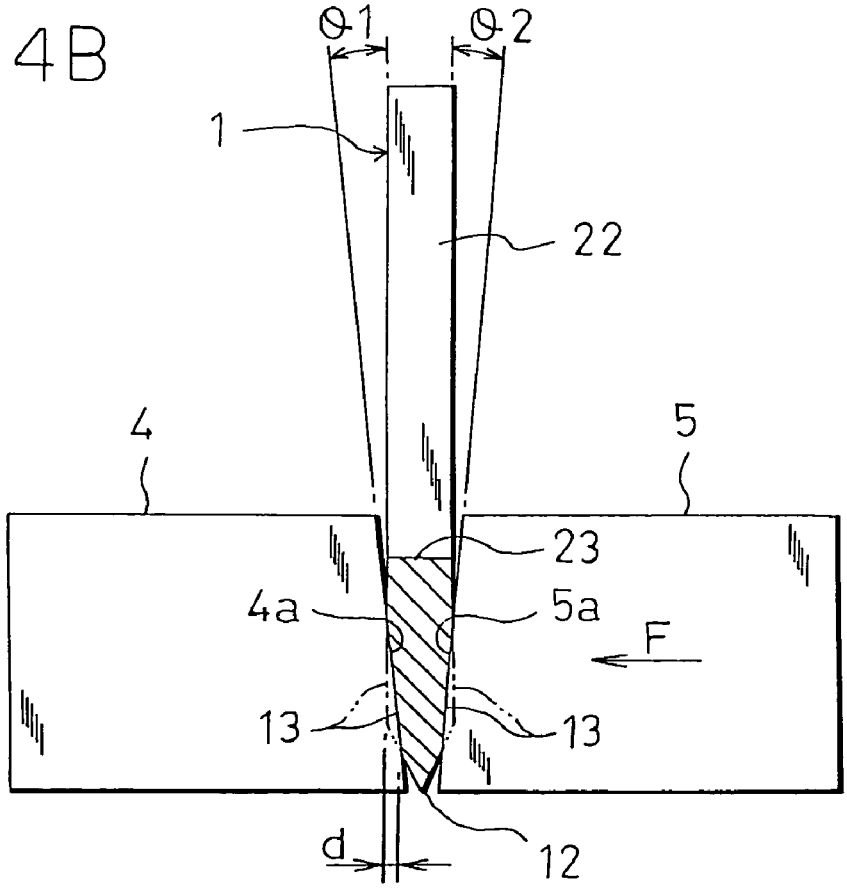
FIG. 4B is a diagrammatic sectional view taken along IV—IV in FIG. 3 where the two pressers are brought into contact with each other, with the blade blank therebetween.
Figure 8:
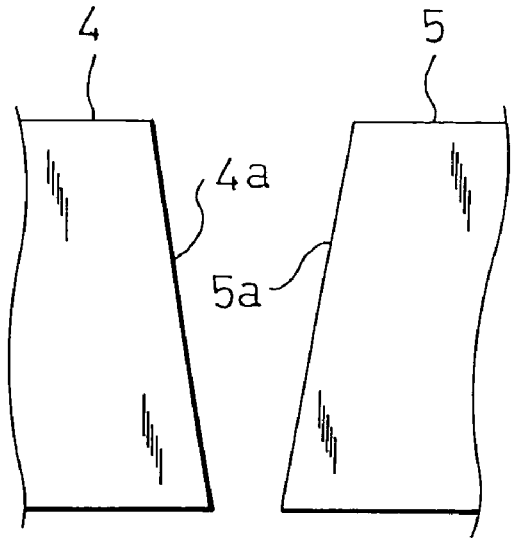
FIG. 8 is a diagrammatic view showing the shapes of the press faces.

As shown in FIGS. 4A and 4B, the blade blank is inserted between the pressers 4 and 5; more exactly, between the two press faces 4*a* and 5*a*. An enlarged view is shown in FIG. 8. FIG. 3 indicates the relationship between the press face 4*a* and the blade blank, especially the slit 22. Each of the press faces 4*a* and 5*a* can have various surfaces, such as flat or convex, depending upon the hardness of the blade blank. As clearly shown in FIG. 4B, the space between the press faces 4*a* and 5*a* diverge upward, because the space is defined by the slant press faces 4*a* and 5*a*. The outside wall 13 of the blade blank is initially straight as shown in chain line 13, and is scraped under the pressure provided by the press faces 4*a* and 5*a* as shown in solid line 13. In this way the top end of the blade blank is sharpened as a whole.

In the illustrated example the press face 4*a* is inclined at θ1 in contrast to the straight sidewall of the blade blank, and the press face 5*a* is equally inclined at θ2, wherein θ1 and θ2 are the same angle but they can be different when desired.

Now, the manner of curving a blade blank by the illustrated apparatus:

Referring to FIGS. 2 and 4A, after the pressers 4 and 5 become separated, the blade blank is vertically suspended between the pressers 4 and 5 with its edge 12 downward. At this stage the motor 16 is started. The presser 5 is rotated in the arrow direction F in FIG. 4. The strip kept into contact with the press face 4*a* of the presser 4, so that the blade blank extends in length under the compression. The reduction in thickness under the compression is indicated by (d) in FIG. 4B.

As described above, the press faces 4*a* and 5*a* diverge upward with respect to the outside wall of the blade blank, so that the compressive force focuses upon a point near the edge 12. As the compression increases, a metal flesh near the edge 12 is elongated longer than a metal flesh portion away from the edge 12. The diverging of the press faces 4*a* and 5*a* is effective to accomplish the sharp edge 12 because of the focused compressive force to around the edge 12.

Figure 5:
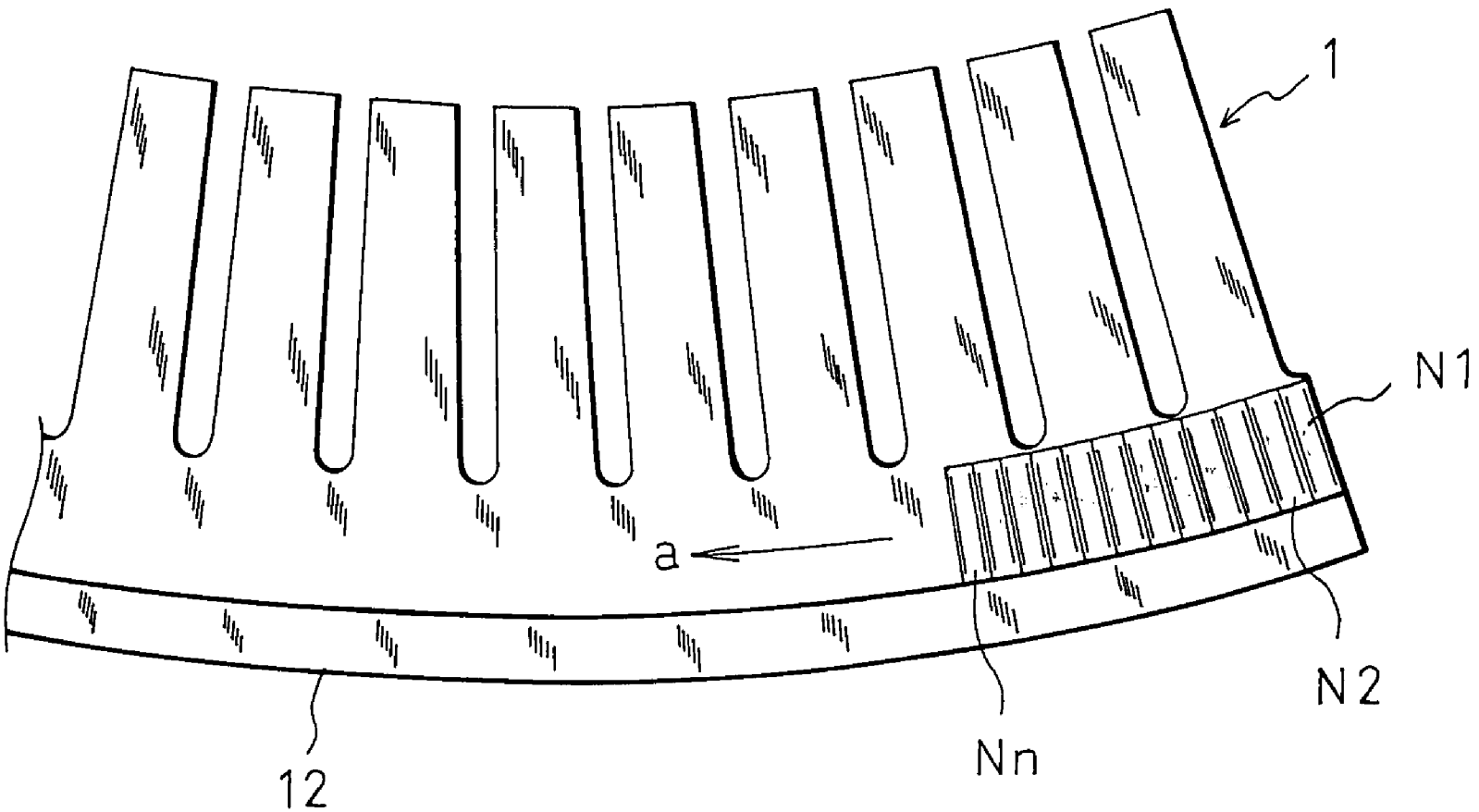
FIG. 5 is an explanatory view illustrating the process of applying compression and elongation to the blade blank.

Then, the process advances to the step where the edge 12 is curved so as to achieve the curved blade blank as shown in FIG. 5. The process is conducted by passing the blade blank consecutively in the direction (a) between the pressers 4 and 5 by N1, N2, N3 . . . Nn. The compression is applied to each part N, N2, N3 . . . Nn. In this way the whole length or a predetermined range of the blade blank is curved as a whole. It is not essential to apply the compression continuously to every part N1, N2, N3 . . . Nn, but it is possible to provide non-compression zones by placing spaces between adjacent parts.

Figure 9:
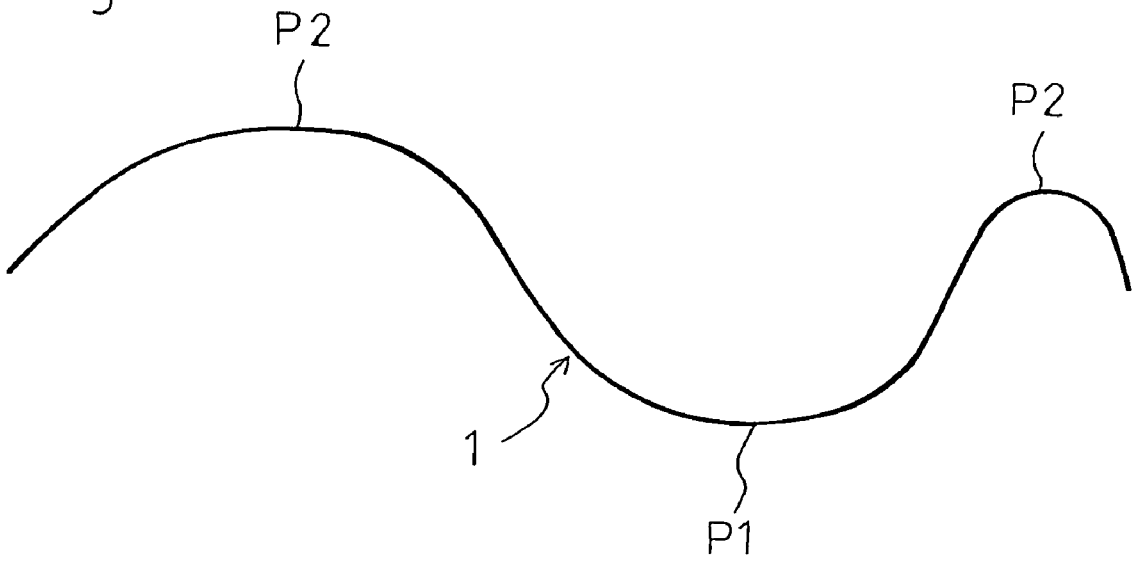
FIG. 9 is a diagrammatic plan view showing a blade blank bent in a direction of thickness.

FIG. 9 diagrammatically shows one example of a possible shape of the blade blank, characterized by a valley portion P1 and hill portions P2 and P3 with the valley portion P1 interposed therebetween.

Figure 11:
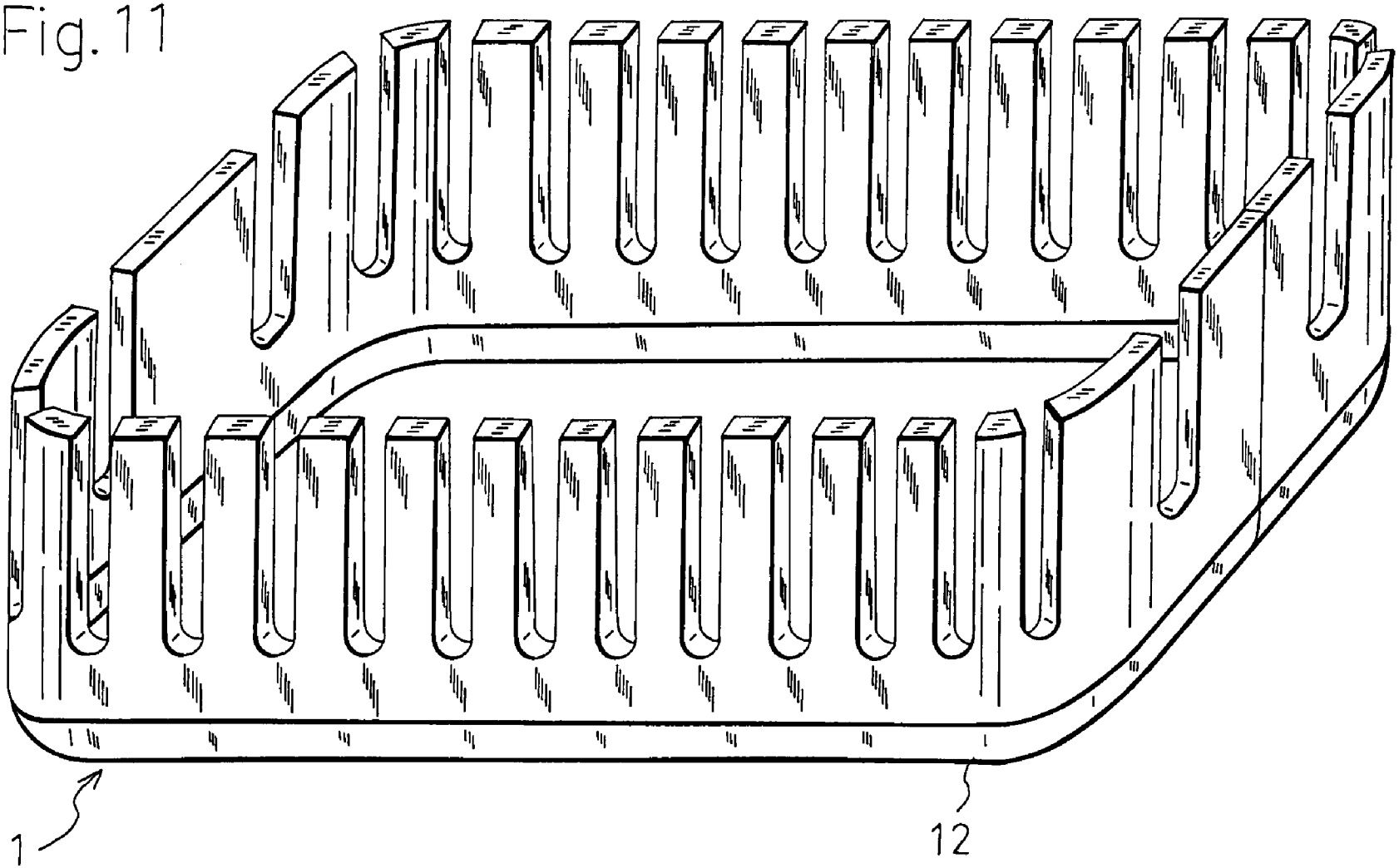
FIG. 11 is a diagrammatic plan view of a pre-curved blade blank.
Figure 12:
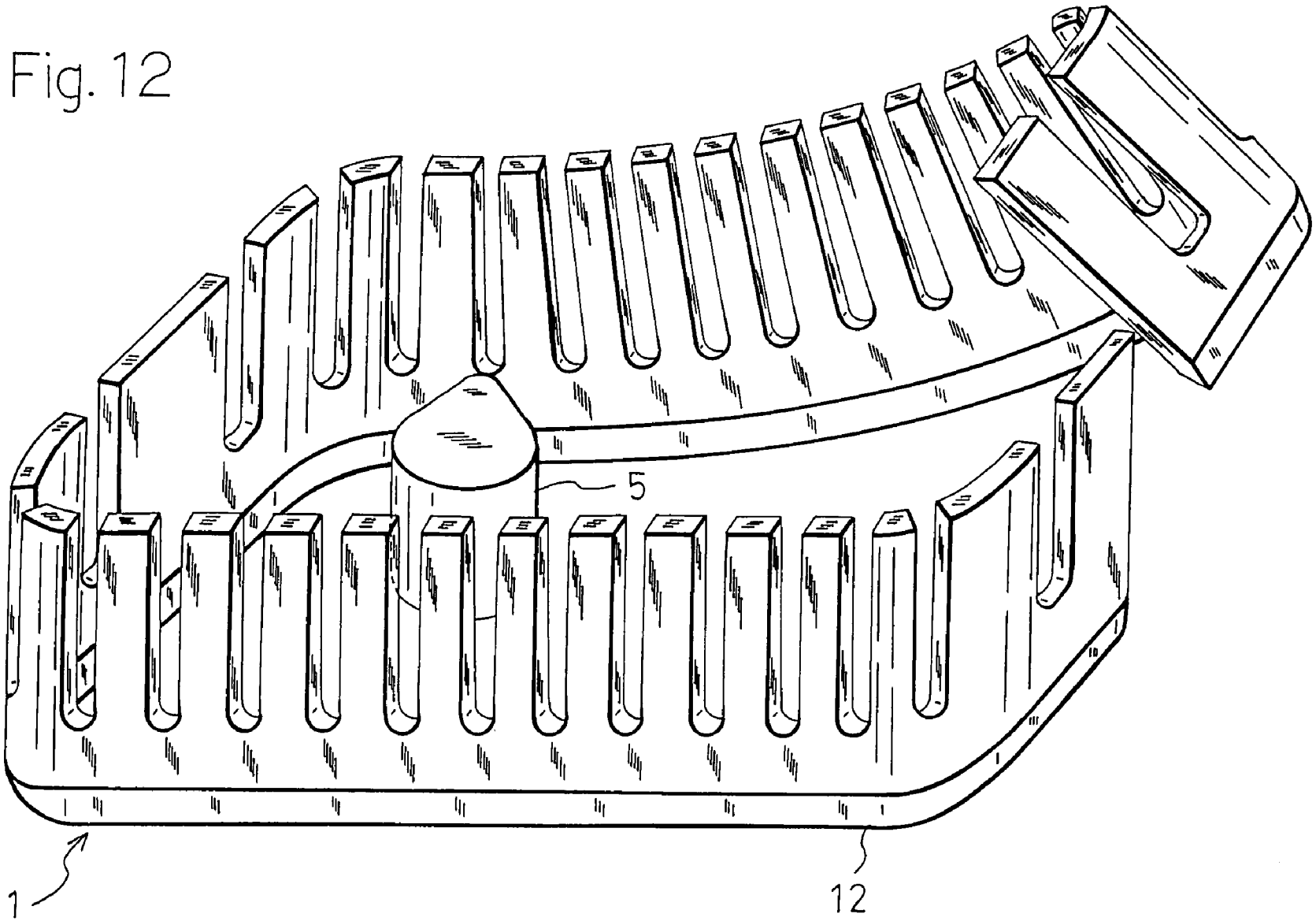
FIG. 12 is a diagrammatic perspective view of a blade blank in the process of being curved.
Figure 13:
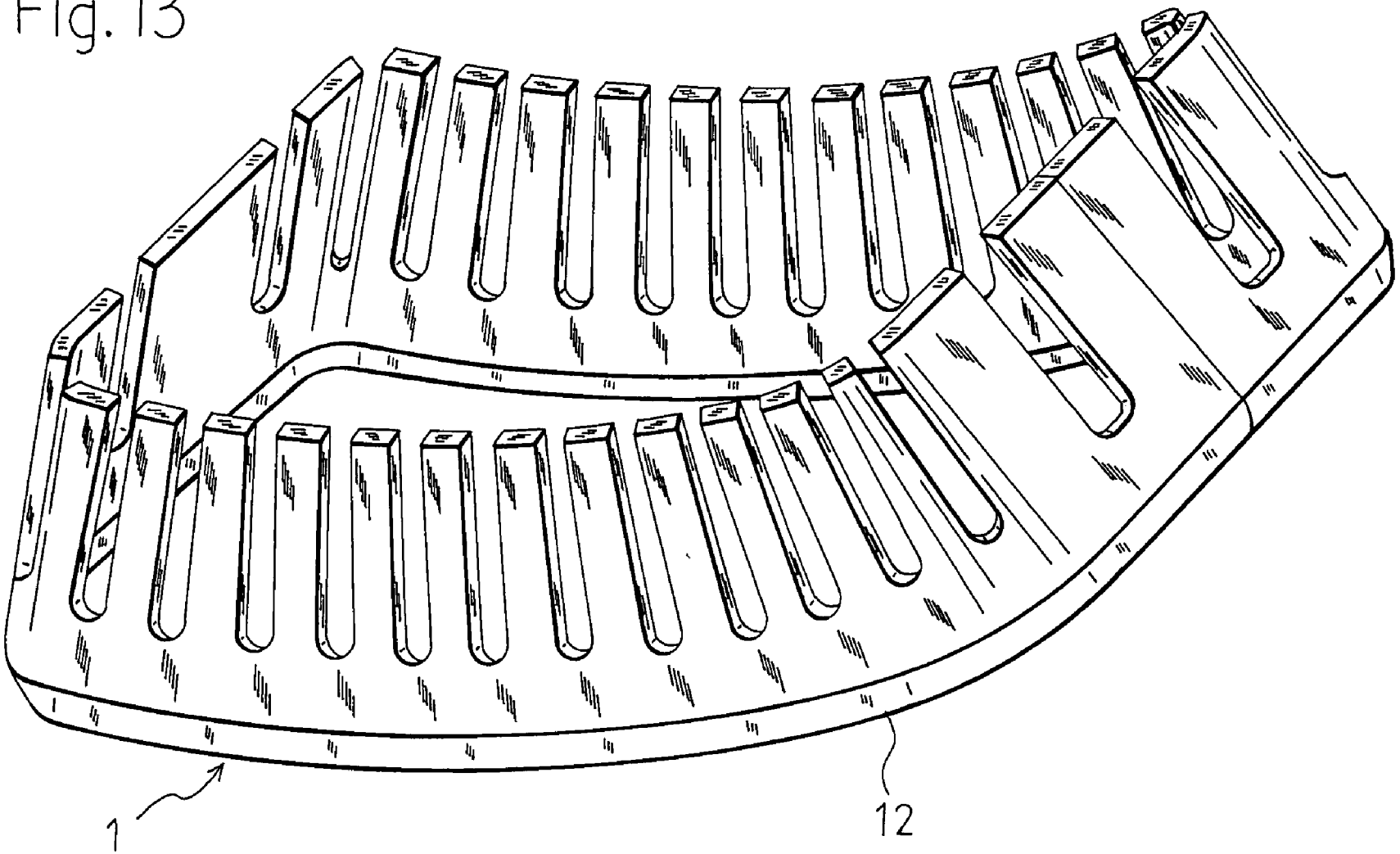
FIG. 13 a diagrammatic perspective view of a blade blank which has been curved.
Figure 14:
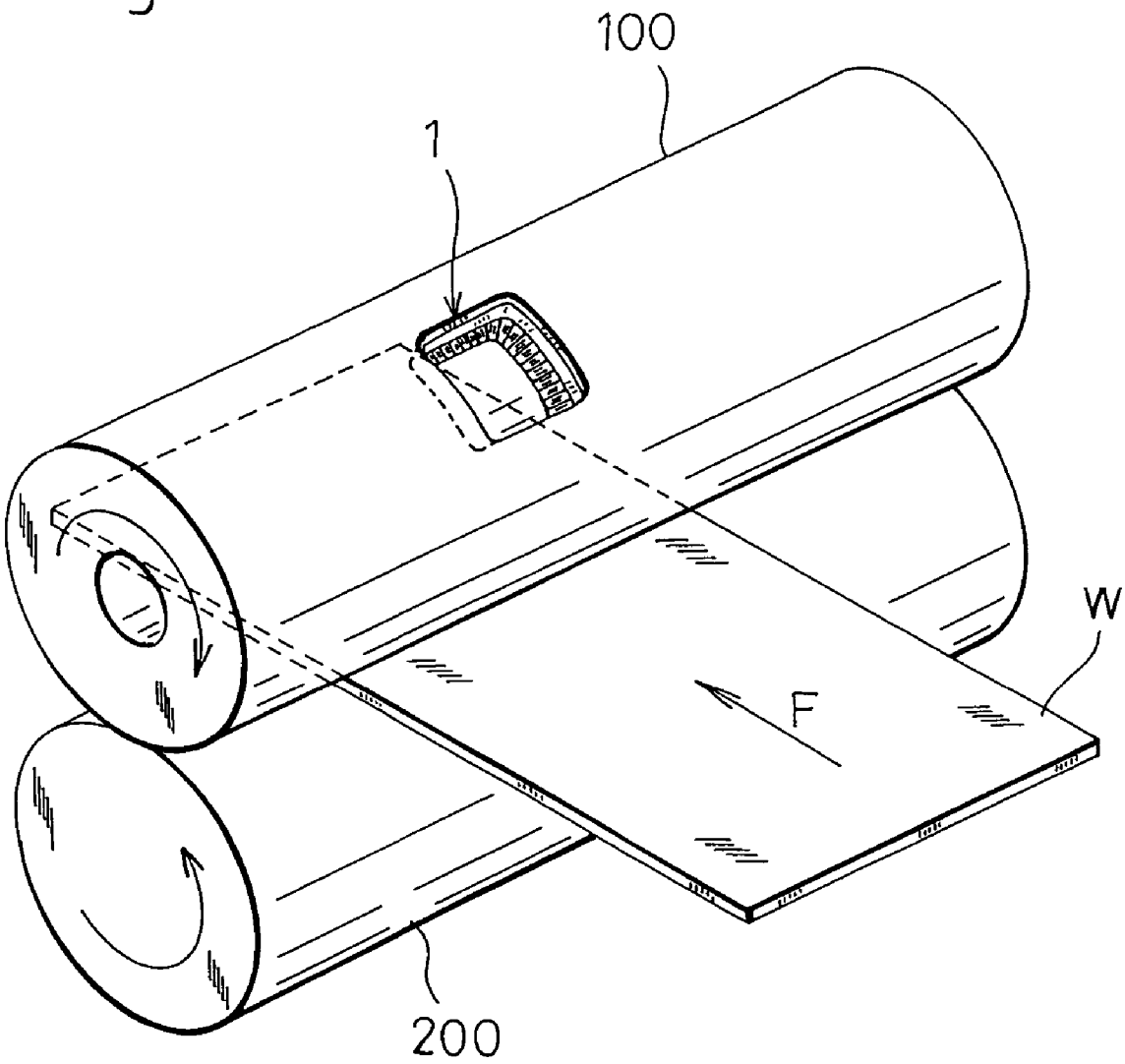
FIG. 14 is a diagrammatic perspective view illustrating the manner of operating the apparatus of the present invention.
Figure 15:
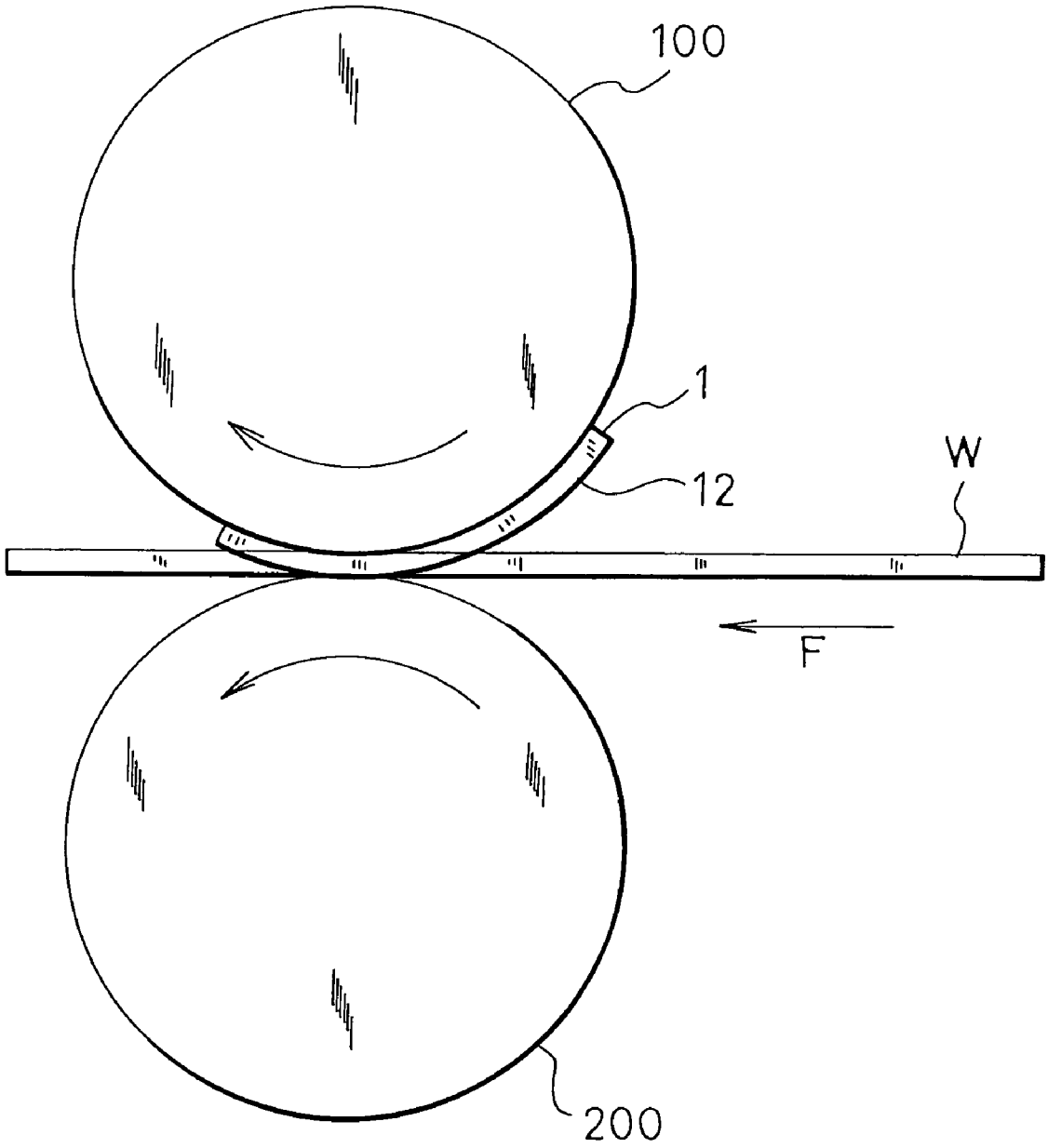
FIG. 15 is a diagrammatic side view illustrating the manner of operating the apparatus of the present invention.
Figure 16:
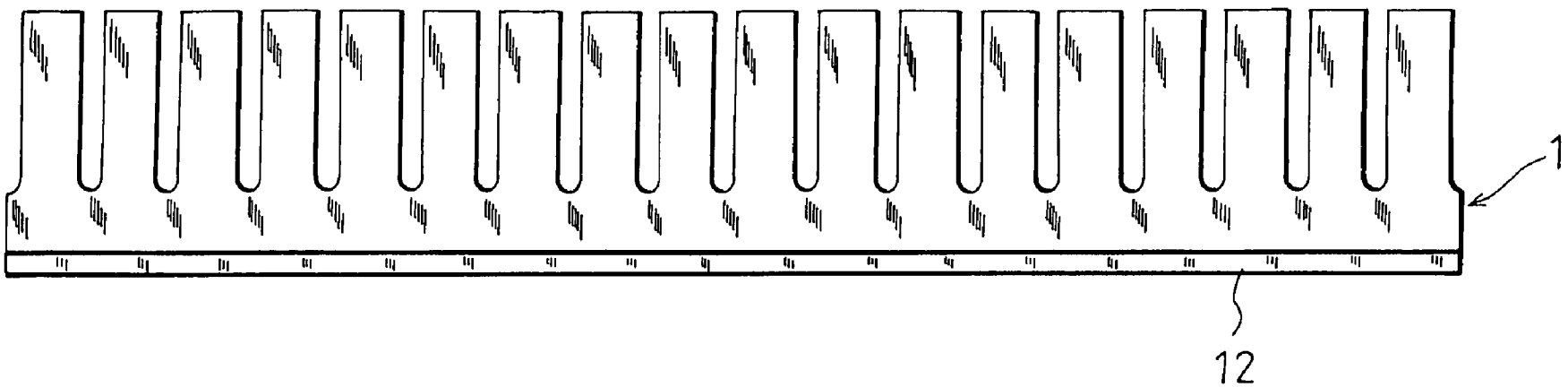
FIG. 16 is a diagrammatic plan view of a strip-like blade blank.
Figure 17:
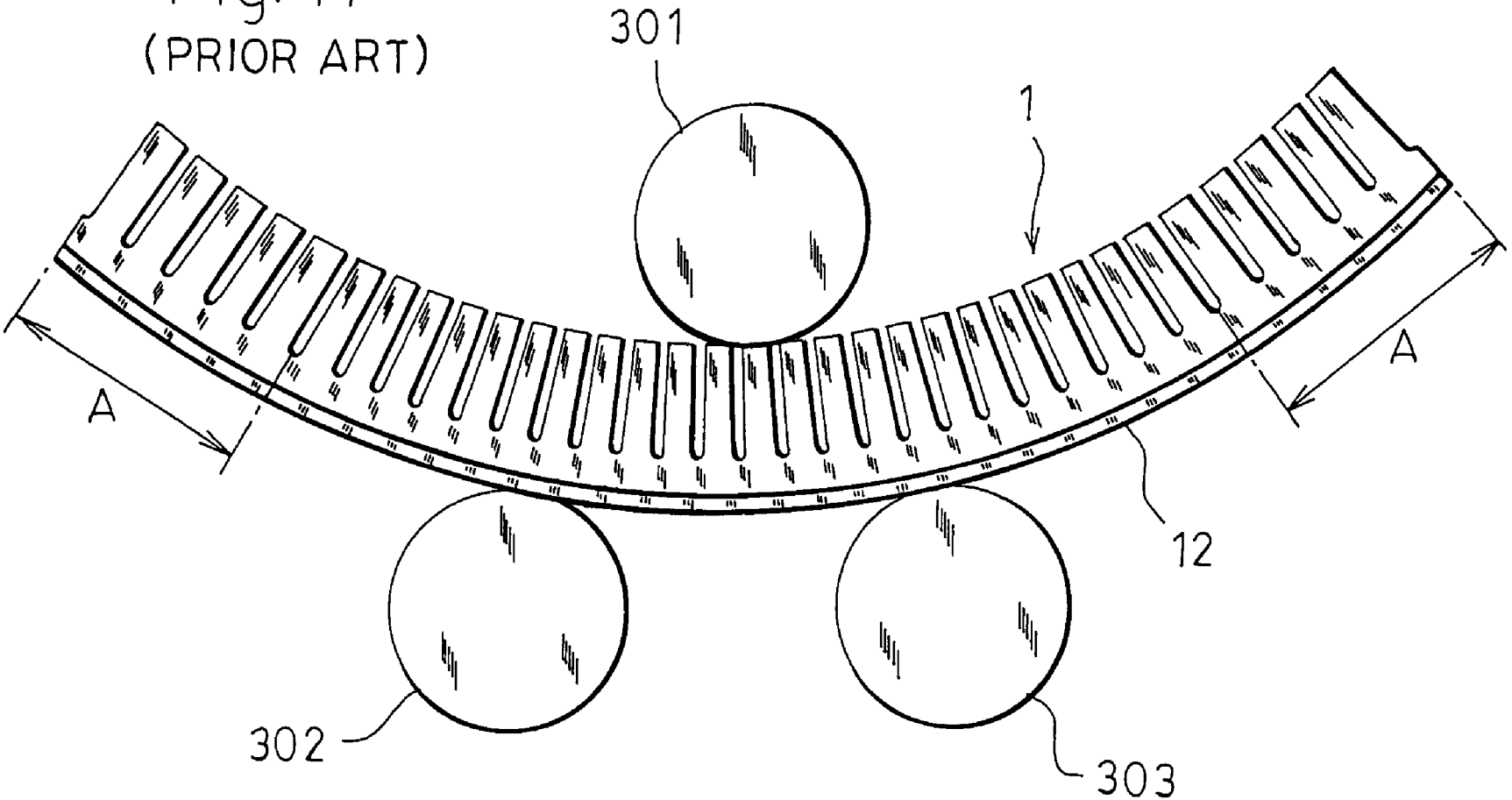
Fig. 17 (PRIOR ART)
FIG. 17 is a diagrammatic view exemplifying the conventional method of curving a blade blank.
Figure 18:
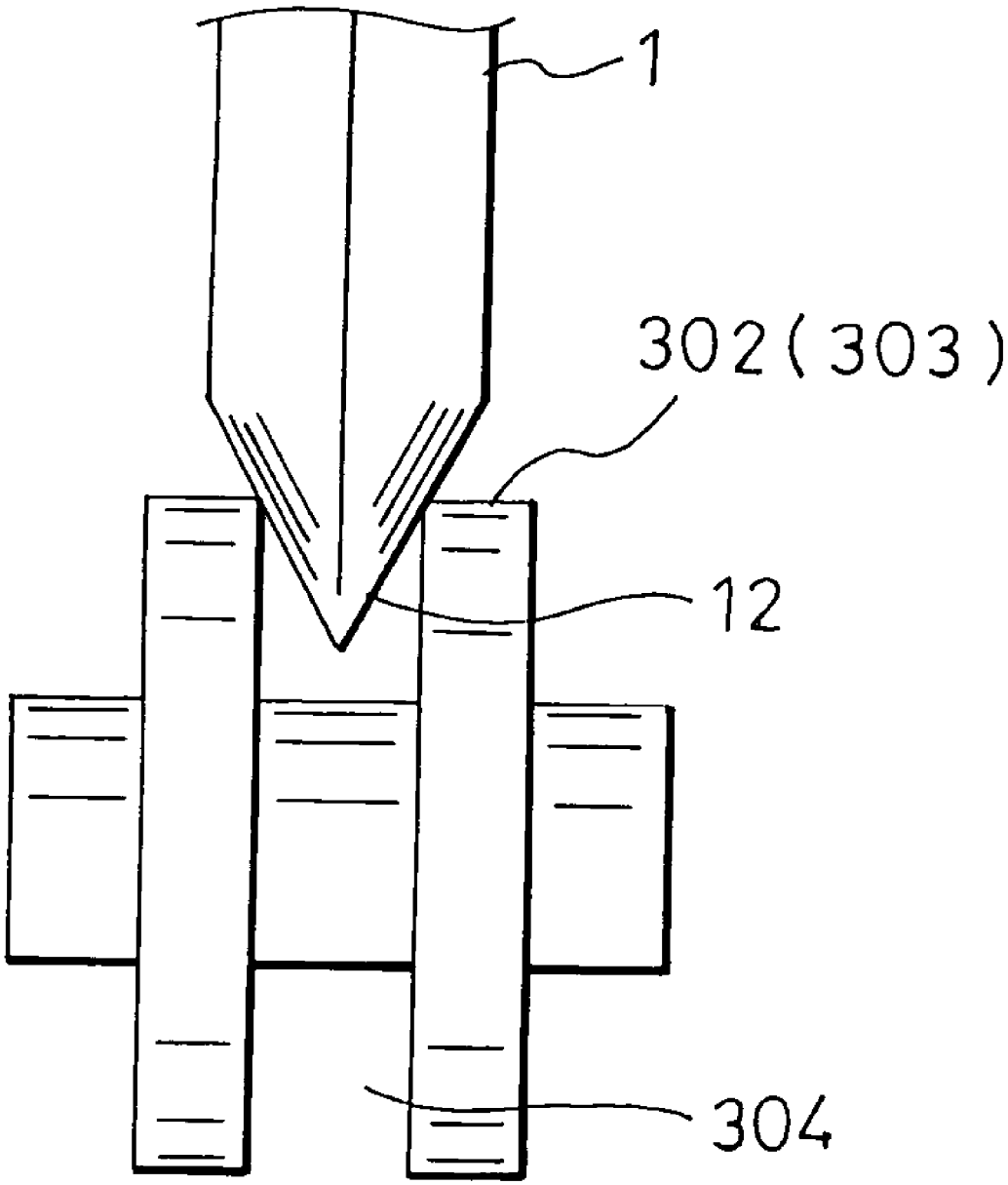
Fig. 18 (PRIOR ART)
FIG. 18 is a diagrammatic view illustrating the conventional roller system of curving a blade blank.
Figure 19:
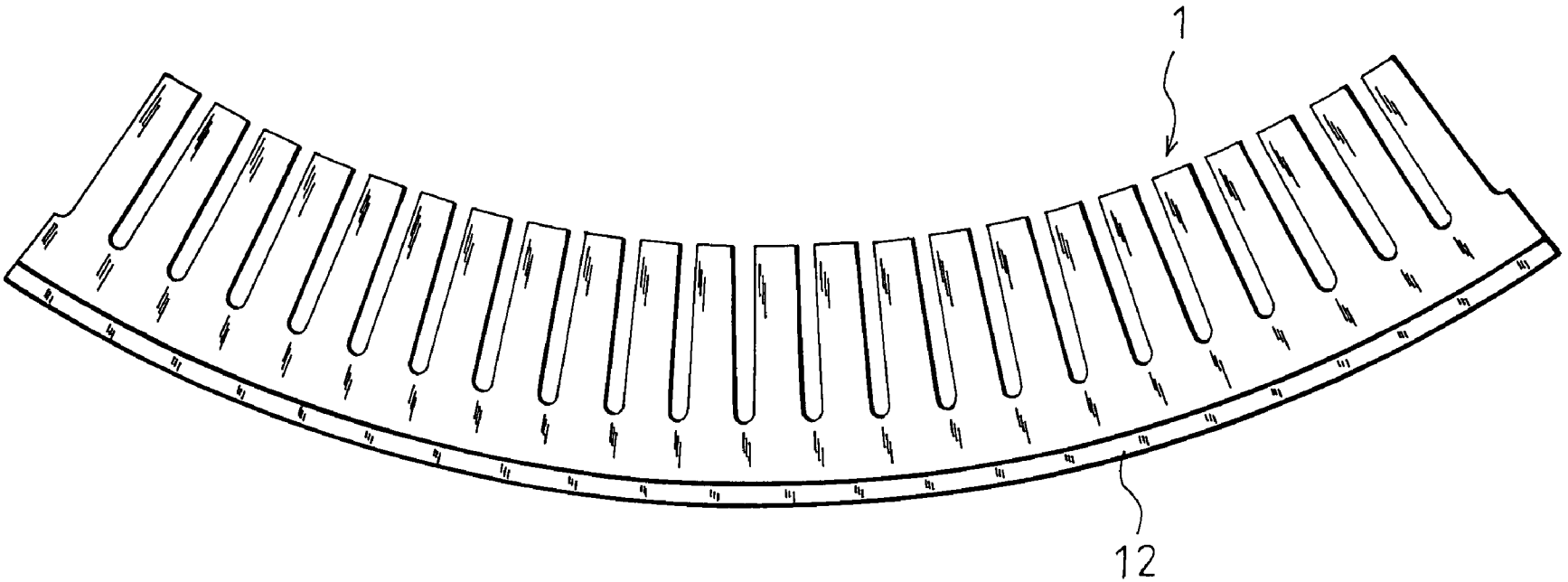
FIG. 19 is a diagrammatic plan view of a curved blade blank available in commerce.

FIGS. 11 to 13 indicate the process of obtaining a special type of blade 1 mounted on a rotary die block 100 illustrated in FIG. 14. FIG. 11 shows a framework-like blade 1 obtained by curving the blade blank. As evident from FIG. 11, the edge 12 is placed on the same plane throughout its length.

FIG. 12 shows a modified blade in which the blade 1 is partly raised by means of the pressers 4 and 5 in the manner shown in FIG. 5. The example of FIG. 12 has its one side alone raised or curved upward, and the example of FIG. 13 has its both sides raised.

The curving can be started at any point along the blade blank, and continued in any range, at its full length or at a part of it. In this case, the same pair of pressers 4 and 5 having the press faces 4*a* and 5*a* as shown in FIG. 8 can be employed.

Figure 6:
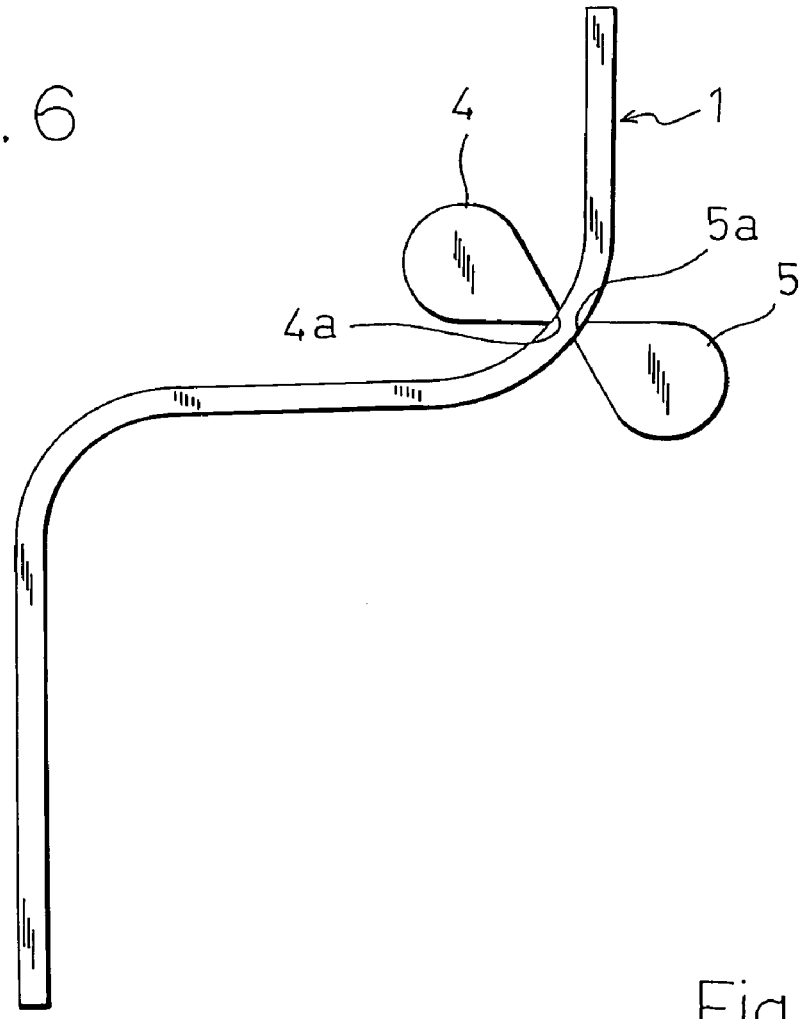
FIG. 6 is a diagrammatic view showing an advantageous case where a presser adapted for shaping the blade blank has a desired shape.
Figure 7:
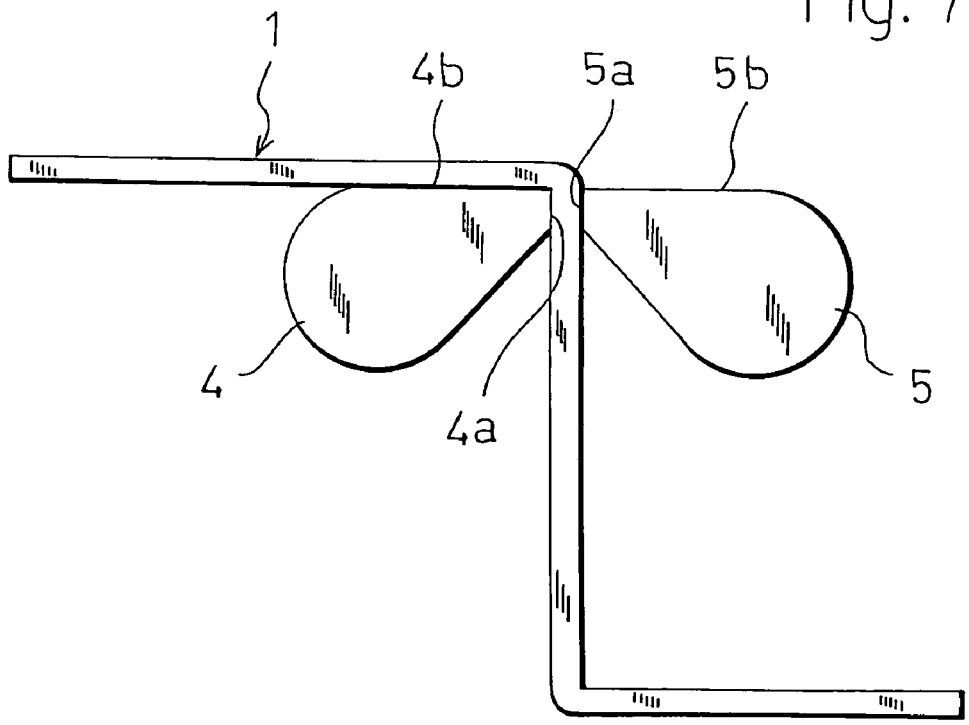
FIG. 7 a diagrammatic view explaining another advantageous case where a presser has a desired shape.

Another modification can be also possible by a process shown in FIG. 6, where the pressers 4 and 5 have sharpened tops whose ends provide press faces 4*a* and 5*a*. FIG. 7 shows a further modification where the pressers 4 and 5 have flat sides 4*b*, 5*b*. The blade blank rests on the flat side 4*b* as shown in FIG. 7. Then it is possible to curve by the paired pressers 4 and 5 the blade blank at a position where it has been bent rectangularly. In this case, the pressers 4 and 5 are also carried on the body 6 and arm portion 7 shown in FIG. 2.

Figure 10:
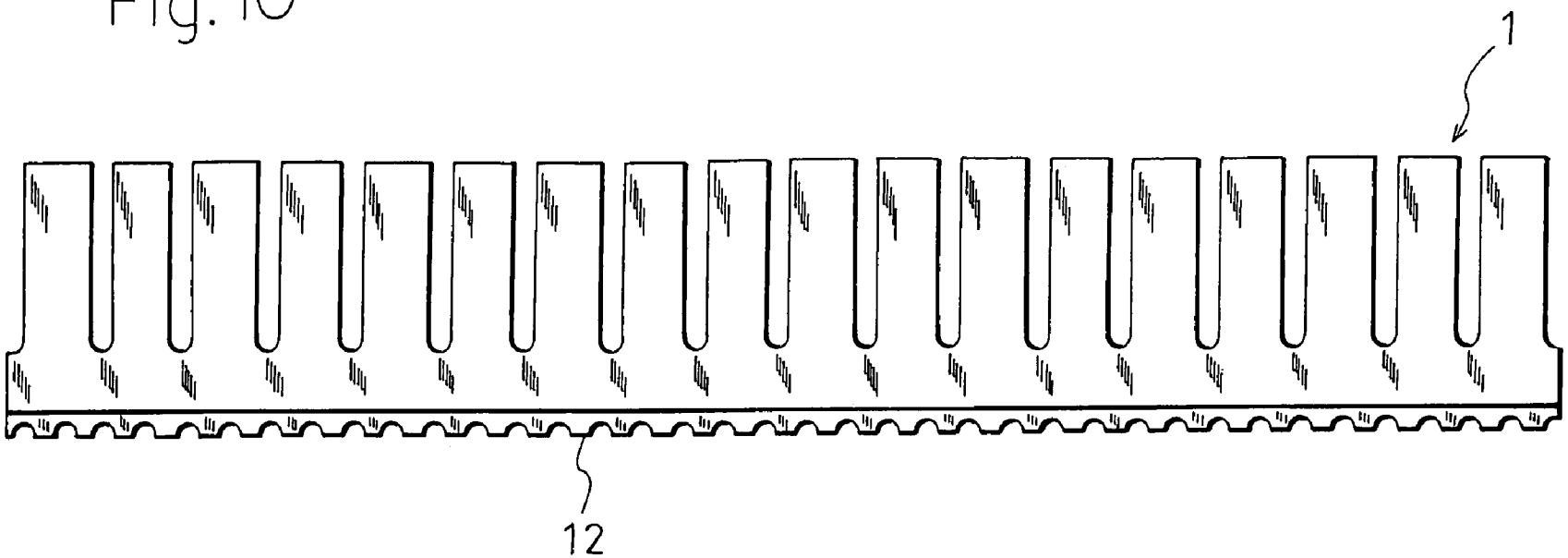
FIG. 10 is a diagrammatic plan view of another type of blade blank.

An example shown in FIG. 10 is unique in having a wavy edge 12. This modified edge 12 is used as a rotary die blade for perforating a material such as paper and cloth to facilitate separation.

In the example shown in FIG. 2, the presser 5 is moved in accordance with the rotation of the shaft 15, and drawn to the other presser 4 or separated therefrom, as the case may be. It is possible to move the presser 5 toward the presser 4 in accordance with the straight movement of the arm 7.

According to the present invention, a straight blade blank can be curved over its full length like an arch or over a predetermined length. When the blade is given a wavy edge as shown in FIG. 10, it can be used as a rotary die blade to perforate a work such as paper and a metal sheet. The operation of the apparatus of the present invention can be computerized, thereby allowing an unskilled operator to operate the apparatus.

What is claimed is:

1. A method for making a rotary die blade from a straight blade blank, comprising the steps of:

inserting a blade blank between a first press face of a first presser and a second press face of a second presser; and compressing the blade blank by separating either of the first press face or the second press face from the other and urging one of them to the other, thereby elongating the blade blank along its length;

wherein the compressive force is differentiated at a position where the blade blank is compressed, such that a stronger compressive force is applied to the peripheral portion of the blade blank than the inner portion thereof in a widthwise direction of the blade blank.

2. The method of claim 1, further comprising the step of bending the blade blank into a desired shape in a thickness direction before the compressing step.

3. The method of claim 1, wherein the blade blank is advanced along its length step by step, with the compression being applied thereto at each step.

4. The method of claim 1, wherein each of the pressers is provided with a narrow press face conformable to the width of the blade blank.

5. The method of claim 4, wherein the pressers have press faces diverging upward with respect to the blade blank.

6. The method of claim 1, wherein the blade blank has an outside rim and is provided with a plurality of slits each of which is produced at intervals and has a bottom, wherein the distance between the bottom of each slit and the outside rim of the blade blank is not larger than one half of the full width.

7. An apparatus for making a rotary die blade from a straight blade blank which has an edge at one end in a widthwise direction, comprising:

a pair of pressers comprising a first and a second presser having narrow press faces arranged with the blade blank placed therebetween so as to be able to separate them from each other and approach them to one another; and a means for separating the pressers from each other and urging the pressers to one another so as to compress and elongate the blade blank, wherein the compressive force is differentiated at a position where the blade blank is compressed, such that a stronger compressive force is applied to the peripheral portion of the blade blank than the inner portion thereof in a widthwise direction of the blade blank.

8. The apparatus of claim 7, further comprising means for enabling the blade blank to advance along its length step by step, with the compression being applied thereto at each step.

9. The apparatus of claim 7, wherein each of the first and second press faces is inclined so as to form an upwardly diverged space between the two press faces, thereby differentiating the compressive force between a lower section and an upper section of the diverged space when the two press faces are brought into contact with each other.

10. The apparatus of claim 7, wherein one of the pressers is fixed, and the other is movable with respect to the fixed presser.

11. The apparatus of claim 7, further comprising a pair of handles each connected to a first carrier through threads so as to enable the first carrier to move horizontally to and from the second presser, each of the handles having a head projecting outside a housing.

12. The apparatus of claim 7, wherein one of the paired pressers is connected to one end of an arm swingable around a support axis and an eccentric cam mechanism for swinging this arm around the support axis is connected to the other end of the arm.

13. The apparatus of claim 7, wherein one of the paired pressers is connected to an inclining mechanism which makes an adjustment to change an inclination angle of its press face.

* * * * *